US009334603B2

(12) United States Patent
Oak et al.

(10) Patent No.: US 9,334,603 B2
(45) Date of Patent: May 10, 2016

(54) CLOTHING DRYER AND CONTROL METHOD THEREOF

(71) Applicant: Samsung Electronics Co., Ltd., Suwon-si (KR)

(72) Inventors: Seong Min Oak, Masan-si (KR); Do Haeng Kim, Suwon-si (KR); Ju Dai Kim, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 63 days.

(21) Appl. No.: 14/244,335

(22) Filed: Apr. 3, 2014

(65) Prior Publication Data

US 2014/0298676 A1 Oct. 9, 2014

(30) Foreign Application Priority Data

Apr. 3, 2013 (KR) ..... 10-2013-0036347

(51) Int. Cl.
*D06F 58/20* (2006.01)
*D06F 58/28* (2006.01)
(Continued)

(52) U.S. Cl.
CPC ..... *D06F 58/28* (2013.01); *D06F 58/04* (2013.01); *D06F 58/08* (2013.01); *D06F 2058/2829* (2013.01); *D06F 2058/2877* (2013.01)

(58) Field of Classification Search
CPC ..... F26B 11/00; F26B 11/06; F26B 21/00; D06F 58/00; D06F 58/06; D06F 58/20
USPC ..... 34/507, 595, 610; 68/5 C, 5 R, 19, 20; 8/139, 149, 159
See application file for complete search history.

(56) References Cited

U.S. PATENT DOCUMENTS 4,488,363 A * 12/1984 Jackson ..... D06F 58/08 34/572
5,852,881 A * 12/1998 Kuroda ..... D06F 58/28 34/527
(Continued)

FOREIGN PATENT DOCUMENTS

DE 10 2006 025 952 12/2007
DE WO 2007141139 A1 * 12/2007 ..... D06F 58/28
(Continued)

OTHER PUBLICATIONS

Partial European Search Report issued Sep. 30, 2014 in European Application No. 14156378.3.
(Continued)

*Primary Examiner* — Stephen M Gravini
(74) *Attorney, Agent, or Firm* — Staas & Halsey LLP

(57) ABSTRACT

A clothing dryer and control method thereof is provided. A conventional dryness sensor may be used, without installation of a separate component, to detect breakage of a belt. Upon detection of belt breakage, the motor is stopped together with report of abnormality of the to reduce cost. A conventional temperature sensor may be used to maintain a proper surface temperature of a door of the clothing dryer, without installation of a separate component. Thereby, harm to a user due to rise in the surface temperature of the door may be prevented, and degradation of drying quality may be prevented. Furthermore, the pipe temperature of a compressor may be used to detect incorrect or broken wiring of the compressor. When incorrect or broken wiring of the compressor is detected, the compress is stopped together with report of to protect the product.

19 Claims, 6 Drawing Sheets

(51) Int. Cl.
*D06F 58/04* (2006.01)
*D06F 58/08* (2006.01)

(56) References Cited

U.S. PATENT DOCUMENTS

2003/0097764 A1* 5/2003 St. Louis ..... D06F 58/28 34/524
2005/0016013 A1* 1/2005 Bang ..... D06F 58/08 34/486
2008/0088989 A1* 4/2008 Johnson ..... D06F 58/08 361/23
2014/0298676 A1* 10/2014 Oak ..... D06F 58/28 34/499
2014/0298678 A1* 10/2014 Tezcan ..... F26B 21/12 34/565

FOREIGN PATENT DOCUMENTS

KR 10-2005-0021830 3/2005
KR 20140120980 A * 10/2014 ..... D06F 58/04
KR EP 2787115 A2 * 10/2014 ..... D06F 58/04
TR WO 2013050262 A1 * 4/2013 ..... D06F 58/206

OTHER PUBLICATIONS

European Decision on Grant dated Dec. 9, 2015 in European Patent Application No. 14156378.3.

* cited by examiner

CLOTHING DRYER AND CONTROL METHOD THEREOF

CROSS-REFERENCE TO RELATED APPLICATIONS

This application claims the priority benefit of Korean Patent Application No. 10-2013-0036347, filed on Apr. 3, 2013 in the Korean Intellectual Property Office, the disclosure of which is incorporated herein by reference.

BACKGROUND

1. Field

Embodiments relate to a clothing dryer to dry objects such as clothes and a control method thereof.

2. Description of the Related Art

A clothing dryer is an apparatus designed to dry clothes to be dried (hereinafter, referred to as an object to be dried) by supplying high temperature air (hot air) into a drum accommodating the object to be dried while the drum is rotated. The drum slowly rotates about a horizontal shaft, and thereby the objects to be dried is tumbled in the drum and dried without stains. Such a clothing dryer is provided with a fan for circulation of air and a motor to rotate the drum. The fan and drum are rotated at a predetermined rotational speed by a rotating shaft of the motor via a transmission mechanism such as a pulley or a belt. The rotation transmission mechanism at the drum includes a pulley installed at the rotating shaft of the motor, a belt wound around the circumferential surface of the pulley and the cylindrical drum, and a tension member to apply tension to the belt. However, in the case that the belt is broken or displaced, the drum may fail to normally rotate and stop. In this case, hot air is intensively supplied to the objects to be dried which are accumulated near an inlet of the drum through which the hot air is introduced into the drum. Thereby, clothes may be deformed or damaged.

In conventional cases, breakage of the belt is detected by installing a micro switch at one side of the motor which is turned by reaction force produced in the case that the belt is broken. However, detecting breakage of the belt using a mechanical device may necessitate a separate component, resulting in increase in cost and degradation of workability on the assembly line.

SUMMARY

In an aspect of one or more embodiments, there is provided a clothing dryer capable of detecting breakage of a belt using a conventional dryness sensor without having a separate component installed and a control method thereof.

In an aspect of one or more embodiments, there is provided a clothing dryer capable of maintaining a proper surface temperature of the door of the clothing dryer using a conventional temperature sensor and a control method thereof.

In an aspect of one or more embodiments, there is provided a clothing dryer capable of detecting incorrect or broken wiring of a compressor of the clothing dryer and a control method thereof.

In an aspect of one or more embodiments, there is provided a control method of a clothing dryer provided with a drum to accommodate an object to be dried, a motor to generate power to rotate the drum, and a belt to transfer the power of the motor to the drum, includes rotating the drum according to operation of the motor to dry the object to be dried, detecting a degree of dryness of the object to be dried for a specific time and calculating change in the degree of dryness, determining that the belt is abnormal if the calculated change in the degree of dryness is equal to or less than a set value for the specific time, and stopping the motor when determining that the belt is abnormal.

The specific time may be a second time since beginning of a drying operation before the first time elapses.

The specific time may be a second time since beginning of the change in the degree of dryness during a drying operation.

The first time may be about 20 minutes, and the second time may be about 10 minutes.

The control method may further include stopping the motor and at the same time stopping a compressor to compress a refrigerant to heat air flowing into the drum, when determining that the belt is abnormal.

The control method may further includes reporting that the belt is abnormal through an alarm or a visible indication, when determining that the belt is abnormal.

In an aspect of one or more embodiments, there is provided a clothing dryer includes a drum to accommodate an object to be dried, a motor to generate power to rotate the drum, a belt to transfer the power of the motor to the drum, a dryness sensor to detect a degree of dryness of the object to be dried, and a controller to detect change in sensor values of the dryness sensor for a specific time to determine whether the belt is abnormal.

The dryness sensor may output pulse values of the degree of dryness of the object to be dried, the degree of dryness being converted into an electrical signal.

The controller may accumulate deviations of the pulse values input through the dryness sensor for a specific time, and determines that the belt is abnormal when a mean absolute deviation of the accumulated pulse values is equal to or less than a set value.

The controller may stop the motor when the controller determines that the belt is abnormal.

When the controller determines that the belt is abnormal, the controller may stop the motor and at the same time stop a compressor to compress a refrigerant to heat air flowing into the drum.

The clothing dryer may further includes a display unit to display abnormality of the belt or an alarm unit to produce an alarm sound or a buzzer sound, in order to report that the belt is abnormal.

In an aspect of one or more embodiments, there is provided a control method of a clothing dryer provided with a drum to accommodate an object to be dried, a motor to rotate the drum, and a compressor to compress a refrigerant to heat air flowing into the drum, includes performing a drying operation by driving the motor and the compressor, detecting a temperature at an outlet of the drum through a temperature sensor during the drying operation, and comparing the detected temperature at the outlet of the drum with a predetermined reference temperature, and controlling operation of the compressor according to a result of the comparison to keep a surface temperature of a door constant.

The temperature sensor may be a thermistor to detect a temperature of air discharged from the drum.

The thermistor may be installed in a discharge channel allowing the air having passed through the drum to be discharged therethrough.

The controlling of the operation of the compressor may include stopping the compressor when the temperature at the outlet of the drum is equal to or higher than a first reference temperature, and driving the compressor when the temperature at the outlet of the drum is equal to or higher than a second reference temperature.

The motor may be driven regardless of whether or not the compressor is stopped.

In an aspect of one or more embodiments, there is provided a control method of a clothing dryer provided with a door and a drum to accommodate an object to be dried, a motor to rotate the drum, and a compressor to compress and discharge a refrigerant through a pipe to heat air flowing into the drum, the control method including performing a drying operation by driving the motor and the compressor; detecting an initial pipe temperature of the pipe using a temperature sensor installed at a discharge side of the compressor at the beginning of the drying operation; determining whether a predetermined time has elapsed during the drying operation; detecting a current pipe temperature after the predetermined time has elapsed and calculating a difference between the initial pipe temperature and the current pipe temperature; and controlling operation of the motor and compressor according to a result of the calculated difference to protect the clothing dryer from damage due to broken wiring or incorrect wiring of the clothing dryer causing a heat surge and informing the user according to the result by a sound or a visual display.

BRIEF DESCRIPTION OF THE DRAWINGS

These and/or other aspects of embodiments will become apparent and more readily appreciated from the following description of embodiments, taken in conjunction with the accompanying drawings of which.

DETAILED DESCRIPTION

Figure 1:
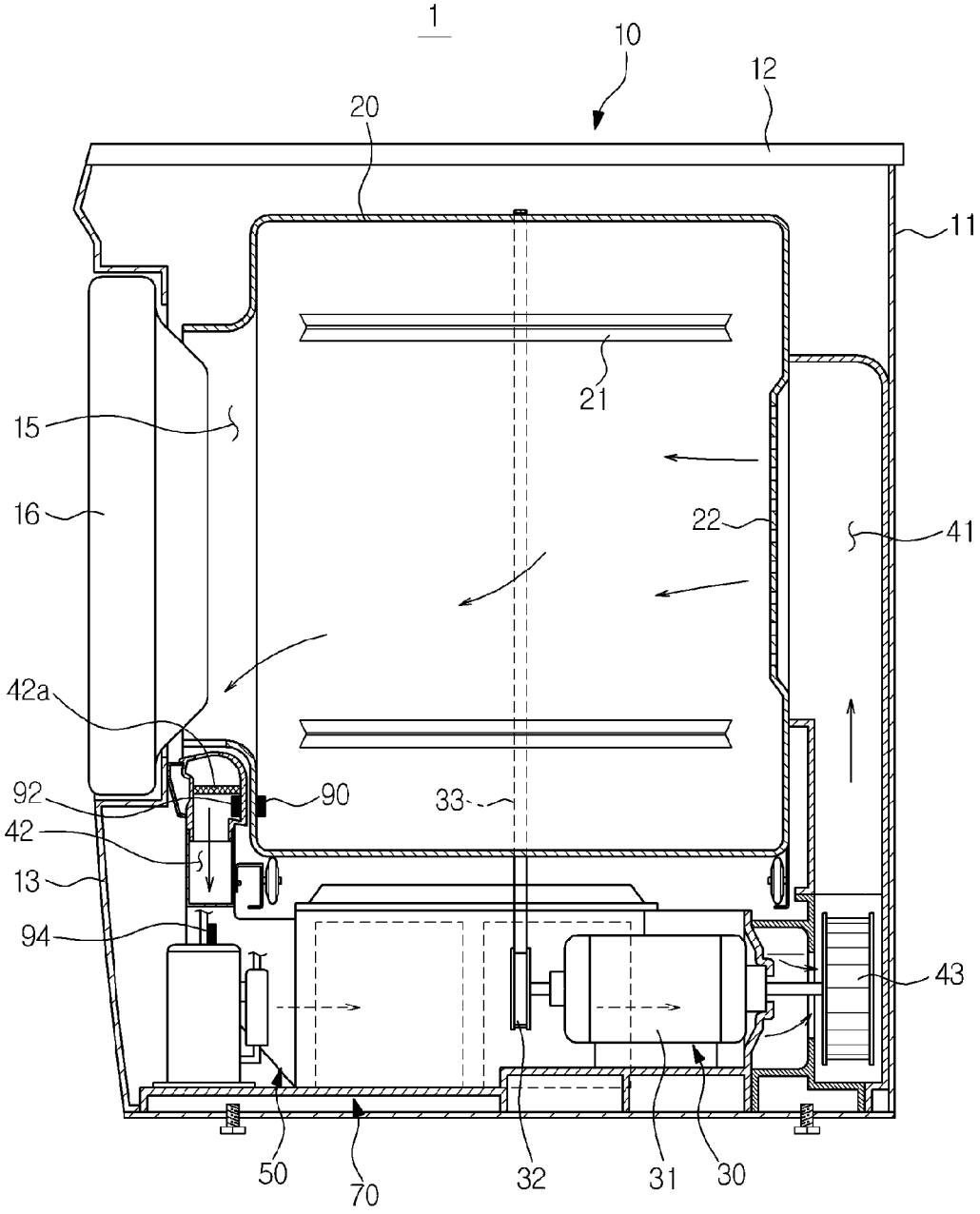
FIG. 1 is a perspective view showing the configuration of a clothing dryer according to an embodiment.

Reference will now be made in detail to embodiments, examples of which are illustrated in the accompanying drawings, wherein like reference numerals refer to like elements throughout.

FIG. 1 is a cross-sectional view showing the configuration of a clothing dryer according to an embodiment.

In FIG. 1, the clothing dryer 1 according to an embodiment includes a body 10 formed approximately in a hexahedral shape, a drum 20 rotatably installed in the body 10 and provided with a space in which objects to be dried such as clothes are dried, a driving unit 30 to drive the drum 20, and a drying unit 40 to supply hot air to the drum 20.

The body 10 may include a cabinet 11, a top cover 12 to cover the upper portion of the cabinet 11, and a front panel 13 disposed on the front surface of the cabinet 11.

An inlet 15 is formed on the front surface of the body 10 to allow an object to be dried to be put into the drum 20 therethrough. A door 16 is hinged to the front of the inlet 15 to open and close the inlet 15.

The drum 20 is rotatably installed in the body 10. A plurality of lifters 21 is disposed inside the drum 20 along a circumferential direction of the drum 20. The lifters 21 repeatedly lift and then drop an object to be dried such that the object is effectively dried.

The front surface of the drum 20 is provided with an opening, and the rear surface of the drum 20 is provided with a hot air inlet 22. The air heated by a dehumidification unit 80 is introduced into the drum 29 through the hot air inlet 22.

The drum 20 is driven by the driving unit 30. The driving unit 30 may include a motor 31 mounted to a base assembly 70, a pulley 32 to receive power from the motor 31 to rotate, and a belt 33 to connect the pulley 32 and the drum 20 to transfer the power of the motor 31 to the drum 20. The belt 33 is installed wound around the outer surface of the drum 20 and the pulley 32 coupled to the shaft of the motor 31.

The drying unit 40 heats air and circulates the heated air to dry an object to be dried in the drum 20. The drying unit 40 may include an inflow channel 41, a discharge channel 42, a fan 43, and a dehumidification unit 50.

The inflow channel 41, disposed at the back of the drum 20, is adapted to communicate with the inside of the drum 20 through the hot air inlet 22 formed at the drum 20.

The fan 43 is disposed inside the inflow channel 41. The fan 43 suctions in hot and dry air which has passed the dehumidification unit 50 and discharges the same into the inflow channel 41, generating a circulating stream passing through the drum 20. The fan 43 may be driven together with the drum 20 by the motor 31.

The discharge channel 42 is disposed at the front of the drum 20 to guide discharge of hot and humid air that has passed through the drum 20. Installed in the discharge channel 42 is a filter member **42*a* to filter out foreign substances such as dust and naps contained in the air discharged from the drum 20**.

Meanwhile, a dryness sensor 90 is installed at the lower end of the front surface of the drum 20 which communicates with the discharge channel 42. The dryness sensor 90 contacts an object to be dried which rotates according to rotation of the drum 20 and measures a sensor value of an electrical signal which varies depending on the amount of moisture contained in the object to be dried, thereby determining a degree of dryness of the object. A plate bar type touch sensor is used as the dryness sensor 90.

In addition, a first temperature sensor 92 to detect the temperature of the air in the drum 20, which dries the object to be dried and is discharged from the drum 20, is installed at the discharge channel 42. The first temperature sensor 92 may be configured with a thermistor whose resistance varies with temperature.

Figure 2:
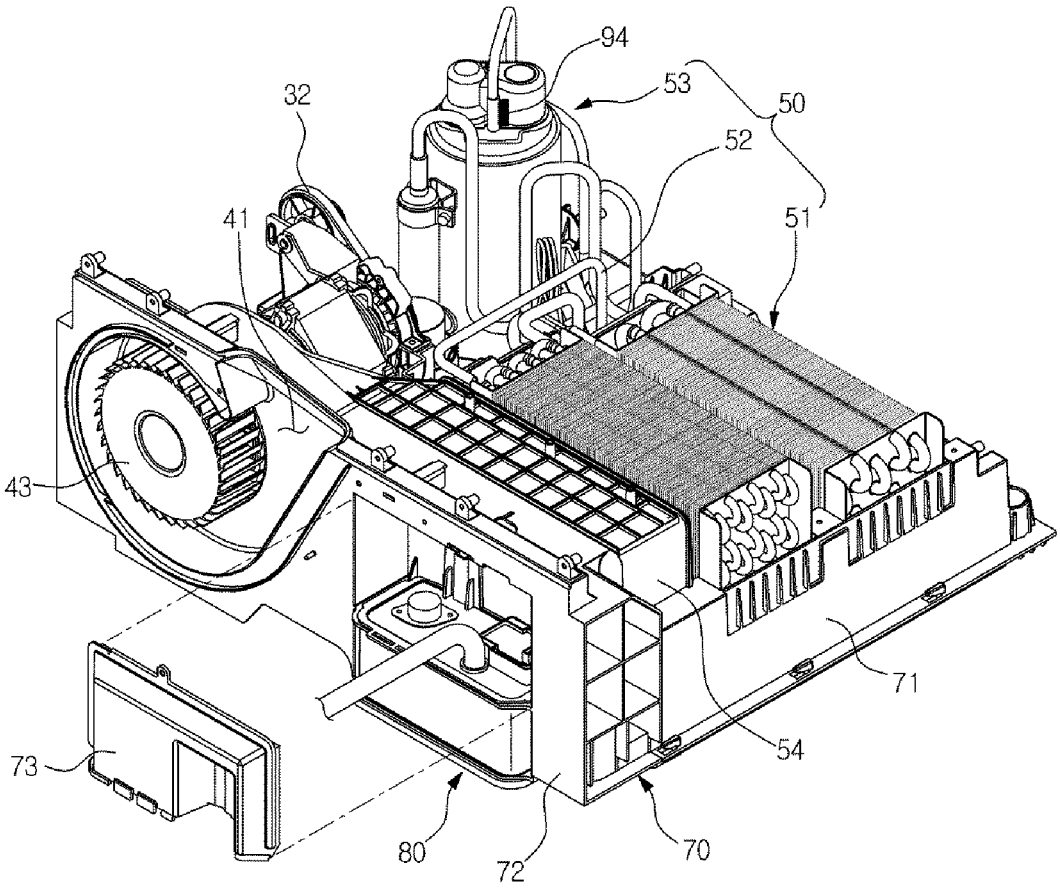
FIG. 2 is a detailed view showing the structure of the base of the clothing dryer according to an embodiment.

FIG. 2 is a detailed view showing the structure of the base of the clothing dryer according to an embodiment.

In FIG. 2, a base 70 is installed at the lower portion of the drum 20. The base 70 is provided with a base body 71 forming the external appearance of the base 70. The fan 43 is mounted to the back of the base body 71. In addition, a rear body 72 provided with a bucket 80, which will be described later, may be mounted to the back of the base body 71.

The dehumidification unit 50, the driving unit 30 and the fan 43 may be mounted to the base 70. Specifically, the dehumidification unit 50 and the driving unit 30 may be mounted to the base body 71, and the fan 43 may be mounted to the rear body 72.

A part of the discharge channel 42 may be formed at the portion of the rear body 72 to which the fan 43 is mounted.

A rear cover 73 to protect the bucket 80 may be separately coupled to the portion of the rear body 72 at which the bucket 80 is formed.

Although not shown in FIG. 2, a base cover (not shown) may be coupled to the upper portion of the base body 71 to cover the dehumidification unit 50 and the driving unit 30.

The dehumidification unit 50 may include an evaporator 51, a condenser 52 and a compressor 53. Although not shown in FIG. 2, the dehumidification unit 50 may further include an expansion valve.

The evaporator 51, the condenser 52 and the compressor 53 of the dehumidification unit 50 are connected by pipes through which a refrigerant passes. Installed at a pipe at the outlet of the compressor 53 is a second temperature sensor 94 to detect the temperature of the refrigerant discharged from the compressor 53, i.e., the temperature of the pipe. The second temperature sensor 94 may be configured with a thermistor whose resistance varies with temperature.

The hot and humid air discharged from the drum 20 (see FIG. 1) flows into the dehumidification unit 50. The hot and humid air introduced into the dehumidification unit 50 then passes through the evaporator 51, through which the refrigerant passes. The refrigerant expands in the evaporator 51 due to pressure drop, thereby absorbing heat. While the refrigerant evaporates and absorbs heat in the evaporator 51, the hot and humid air cools down, losing moisture in the process, and turns into cold and dry air. That is, the hot and humid air discharged from the drum 20 turns into cold and dry air while passing through the evaporator 51.

The cold and dry air having passed through the evaporator 51 subsequently passes through the condenser 52. The refrigerant overheated by being compressed by the compressor 53 passes through the condenser 52. While passing through the condenser 52, the overheated refrigerant dissipates heat. On the other hand, the cold and dry air is heated into hot and dry air. That is, the cold and dry air discharged from the evaporator 51 turns into a hot and dry air while passing through the condenser 52.

Thereafter, the hot and dry air having passed through the condenser 52 is guided along a guide channel 54 into the inflow channel 41. The hot and dry air guided into the inflow channel 41 is caused to flow along the inflow channel 41 toward the drum 20 by the fan 43.

When the drying operation begins, the motor 31 and the compressor 53 are driven. The fan 43 is rotated by the motor 31 to generate air flow, and the compressor 53 compresses the refrigerant at high temperature and high pressure to circulate the refrigerant. The refrigerant compressed at high temperature and high pressure by the compressor 53 passes through the condenser 52 and the evaporator 51, and is then suctioned into the compressor 53, thus forming a refrigerant cycle. During this process, the air turns into hot and dry air while passing through the evaporator 51 and the condenser 52, and is then introduced into the drum 20. The hot and dry air introduced into the drum 20 removes moisture from the object to be dried which has been put into the drum 20 to dry the object. In the process, the air turns into hot and humid air. The hot and humid air flows along the discharge channel 42 and enters the dehumidification unit 50 where it is turned into hot and dry air. The hot and dry air in turn flows into the drum 20.

When moisture is separated by cooling of the hot and humid air discharged from the drum 20 in the evaporator 51, condensed water is produced. The condensed water is collected in a bucket 80 mounted to the base 70.

In addition, the power of the motor 31 is transferred to the drum 33 via the belt 33 to rotate the drum 20. Thereby, the object to be dried is uniformly dried while being moved.

Figure 3:
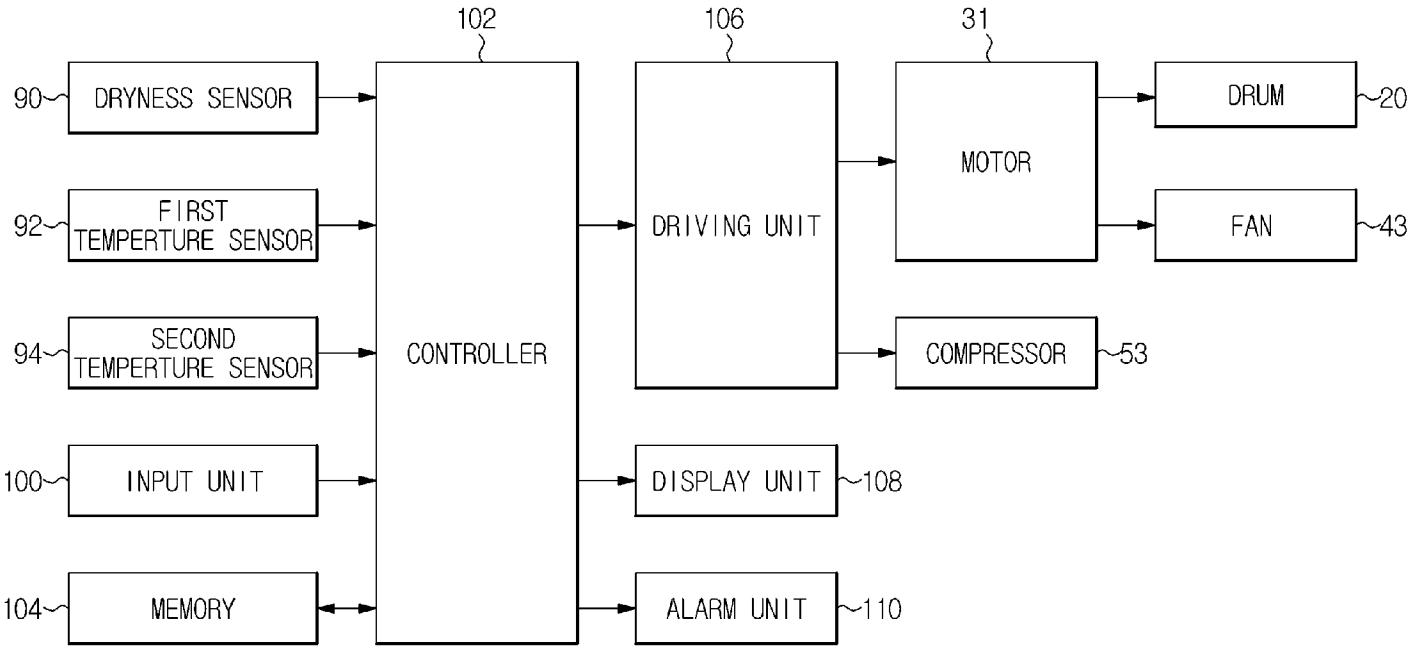
FIG. 3 is a control block diagram illustrating the clothing dryer according to an embodiment.

FIG. 3 is a control block diagram illustrating the clothing dryer according to an embodiment.

In FIG. 3, the clothing dryer 1 of an embodiment includes a dryness sensor 90, a first temperature sensor 92, a second temperature sensor 94, an input unit 100, a controller 102, a memory 104, a driving unit 106, a display unit 108, and an alarm unit 110.

The dryness sensor 90 detects a degree of dryness of an object to be dried using a pulse signal generated when it contacts the object, and then transmits the detected degree of dryness to the controller 102.

The first temperature sensor 92 detects the temperature of the air in the drum 20 accommodating the object to be dried, i.e., the temperature at the outlet of the drum 20, and transmits the detected temperature to the controller 102.

The second temperature sensor 94 detects the temperature of the refrigerant discharged from the compressor 53, i.e., the temperature of the pipe connected to the outlet of the compressor 53, and transmits the detected temperature to the controller 102.

The input unit 100 is used to input, to the controller 102, operational information, selected by a user, which involves a drying course (for example, a normal drying course, a towel-drying course, a permanent press drying course and a delicate drying course), drying time and an operational command. The input unit 100 may be configured with various buttons disposed on a control panel.

In addition to the above buttons, the input unit 100 may be provided with a jog dial to allow selection of a type of drying (for example, semi-drying and complete drying). The input unit 100 may be separately provided with an adjustment button to adjust the operation factor of the selected drying course and the selected drying time.

In addition, the input unit 100 may be configured with a key, a switch, a touch pad, and any other components which generate predetermined input data by being pushed, touched, pressed or turned.

The controller 102 is a microcomputer which controls overall operations of the clothing dryer 1 according to operational information input through the input unit 100. Depending on the degree of dryness of the object to be dried, as determined by the dryness sensor 90, the controller 102 subdivides the drying course to control the drying operation.

In addition, the controller 102 determines breaking of the belt 33 using the dryness sensor 90 at the beginning of the drying operation or during the drying operation. In the case that the change in the sensor value (the mean absolute deviation of pulse signals) detected by the dryness sensor 90 at the beginning of the drying operation or during the drying operation is kept equal to or less than, for example, 5 (a reference value of the absolute deviations to determine breakage of the belt 33) until a second time (about 10 minutes, a reference time taken to accumulate deviations of the pulse values to determine breakage of the belt 33) elapses, the controller 102 determines that the belt 33 is broken. Accordingly, the controller 102 stops the motor 31 and the compressor 53 and reports abnormal state of the belt 33 by sounding an alarm or displaying a message.

In addition, the controller 102 maintains a proper surface temperature of the door 16 using the first temperature sensor 92 during the drying operation. While the drying operation is proceeding, the first temperature sensor 92 detects the temperature of the air in the drum 20 accommodating the object to be dried, i.e., the temperature at the outlet of the drum 20. In the case that the detected temperature is equal to or greater than a determined first reference temperature (the minimum temperature which may cause a burn due to the hot surface temperature of the door 16 (about 60° C.)), the controller 102 stops the compressor 53. In the case that the temperature at the outlet of the drum 20 is equal to or less than a determined second reference temperature (the maximum temperature making the objects to be dried cold enough to result in a lower drying efficiency, about 50° C.), the controller 102 drives the compressor 53 to keep the inside of the drum 20 at a proper temperature to control the surface temperature of the door 16.

In addition, the controller 102 determines incorrect or broken wiring of the compressor 53 using the second temperature sensor 94 at the beginning of the drying operation. In the case that the change in the sensor values detected by the second temperature sensor 94 within a third time (the maximum amount of time needed to detect incorrect or broken wiring of the compressor 53, about 10 minutes) immediately after the beginning of the drying operation, i.e., the change in temperature of the pipe ($\Delta T$) is equal to or greater than a reference change ($\Delta Ts$, the change in pipe temperature due to incorrect or broken wiring of the compressor 53, which is about 50° C.), the controller 102 determining that there is incorrect or broken wiring of the compressor 53. Accordingly, the controller 102 stops the motor 31 and the compressor 53 and reports incorrect or broken wiring of the compressor 53 by sounding an alarm or displaying a message.

The memory 104 may store reference data used during control of the operation of the clothing dryer 1, operation data produced while the clothing dryer 1 performs the drying operation, setting information such as setting date input through the input unit 100 to cause the clothing dryer 1 to perform the drying operation, the number of times the clothing dryer 1 has performed a specific operation, user information including model information about the clothing dryer 1, and malfunction information including causes of malfunction or position of the malfunctioning part of the clothing dryer 1.

The driving unit 106 drives the motor 31 and the compressor 53 which are related to operations of the clothing dryer 1 according to a driving control signal from the controller 102.

The display unit 108 displays the operational state of the clothing dryer 1 according to a display control signal from the controller 102. In addition, the display unit 108 displays user touch manipulation by recognizing the touch information input through the user interface by the user.

In the case that the display unit 108 is a liquid crystal display user interface (LCD UI) capable of displaying a text message, breakage of the belt 33 or incorrect or broken wiring of the compressor 53 is displayed as a text message to allow the user to take proper actions.

In addition, when a light emitting diode user interface (LED UI) is used as the display unit 108, the LED UI allows the user to recognize the abnormal state of the clothing dryer 1 by lighting or flickering, or by using different durations of lighting.

The alarm unit 110 sounds an alarm or a voice according to an alarm control signal from the controller 102 when breakage of the belt 33 or incorrect or broken wiring of the compressor 53 is detected, allowing the user to recognize the abnormal state of the clothing dryer 1.

Hereinafter, a description will be given of procedures and effects of operation of a clothing dryer and a control method thereof according to an embodiment.

Detection of breakage of the belt 33 at the beginning of or during the drying operation will first be described with reference to FIG. 4.

Figure 4:
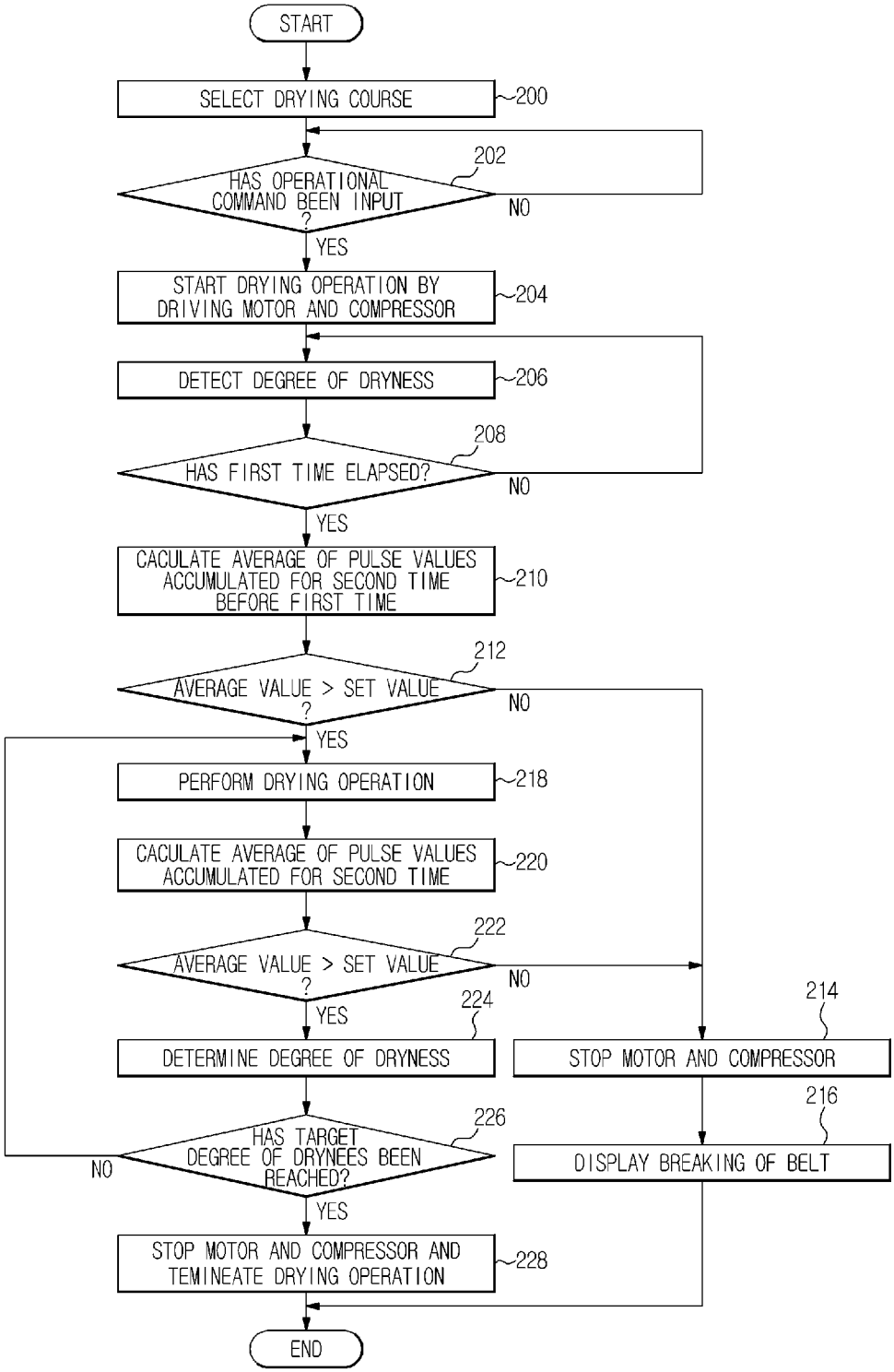
FIG. 4 is a flowchart illustrating a control algorithm to detect breakage of a belt in a clothing dryer according to an embodiment.

FIG. 4 is a flowchart showing a control algorithm to detect breakage of a belt in a clothing dryer according to an embodiment.

In FIG. 4, once the user puts objects to be dried into the drum 20 and selects one of the drying courses (including a normal-drying course, a towel-drying course, a perm-drying course and a delicate-drying course) according to the type of the objects to be dried (200), the information on the course (operation) selected by the user is input to the controller 102 through the input unit 100.

Then, the controller 102 determines whether an operational command has been input, to begin the drying operation according to the information on the drying course input through the input unit 100 (202).

When it is determined that an operational command has been input in operation 202, the controller 102 drives the motor 31 and the compressor 53 through the driving unit 106 to perform the drying operation (204).

When the drying operation begins, air begins to flow into the clothing dryer 1 according to rotation of the fan 43 by operation of the motor 31, and the power of the motor 31 is transferred to the drum 20 via the belt 33. Thereby, the drum 20 rotates according to the transferred power, rotating the objects to be dried in the drum 20.

At this time, the compressor 53 compresses and discharges the refrigerant at high temperature and high pressure to heat the air moving in the clothing dryer 1. The refrigerant compressed at high temperature and high pressure by the compressor 53 releases heat, forming a refrigeration cycle by passing through the condenser 52 and the evaporator 51 and then being suctioned into the compressor 53.

Accordingly, the air flowing in the clothing dryer 1 turns into hot and dry air as it passes through the condenser 52 of the dehumidification unit 50. Then, the hot and dry air is guided into the inflow channel 41 along the guide channel 54. The hot and dry air (hot air) guided into the inflow channel 41 is caused to flow along the inflow channel 41 and enter the drum 20 through the hot air inlet 22, by rotation of the fan 43. The hot and dry air (hot air) introduced into the drum 20 contacts the objects to be dried which are repeatedly lifted and dropped by being rotated in the drum 20, drying the objects by evaporating the moisture contained in the objects.

As the drying operation begins as above, the objects to be dried in the drum 20 start to become dry. The change in the degree of dryness of the objects to be dried which occurs during the drying operation is detected and input into the controller 102 by the dryness sensor 90 (206).

At this time, the dryness sensor 90 outputs pulse values by converting the degree of dryness of the objects to be dried obtained by contacting the objects into electrical signals.

In the case that the belt 33 to transfer power of the motor 31 to the drum 20 is broken or displaced, the drum 20 does not normally rotate but stops. In this case, the hot and dry air (hot air) is intensively supplied to the objects accumulated near the hot air inlet 22 allowing the hot air to enter the drum 20. Thereby, the hot air is hardly supplied to the objects placed at the position opposite the hot air inlet 22.

Thereby, the change of pulse values detected by the dryness sensor 90 is kept equal to or less than a certain value. This is because the dryness sensor 90 is installed at the discharge channel 42 which is located at the position opposite the hot air inlet 22.

Accordingly, the controller 102 determines whether a first time (first time period) (about 20 minutes, the drying time for determination of breakage of the belt) has elapsed since the beginning of the drying operation (208). In the case that the first time has not elapsed since the beginning of the drying operation, the controller 102 returns to operation 206 and converts the degree of dryness of the objects to be dried into electrical signals using the dryness sensor 90 to output pulse values.

When it is determined that the first time (first time period) has elapsed since the beginning of the drying operation in operation 208, the controller 102 calculates the mean absolute deviation of pulse values that have been cumulated for a second time (second time period) (about 10 minutes, a reference time needed to cumulate deviations of pulse values to determine breakage of the belt 33) before the first time elapses (210). Herein, the mean absolute deviation refers to a value obtained by averaging the absolute deviations of the pulse values detected by the dryness sensor 90 which have been accumulated for a specific time (the second time).

Then, the controller 102 compares the average value calculated at the beginning of the drying operation with a set value (for example, 5, a reference value of the absolute deviations to determine breakage of the belt 33) (212). In the case that the average value is equal to or less than the set value, the controller 102 stops the motor 31 and the compressor 53 through the driving unit 106 and terminates the drying operation, determining that the belt 33 has been broken at the beginning of the drying operation (214).

Then, the controller 102 displays breakage of the belt through the display unit 108 and sounds an alarm or a voice through the alarm unit 110 such that the user recognizes breakage of the belt 33 (216).

When it is determined that the average value calculated at the beginning of the drying operation is greater than the set value in operation 212, the controller 102 controls operation of the motor 31 and the compressor 53 through the driving unit 106 to continue the drying operation, determining that the belt 33 is in a normal state at the beginning of the drying operation (218).

Breakage of the belt 33 may occur during the drying operation. Accordingly, the controller 102 continues to calculate the mean absolute deviation of pulse values that have been cumulated for the second time (about 10 minutes, a reference time needed to determine breakage of the belt 33) while the drying operation is proceeding (220).

Then, the controller 102 compares the average value calculated during the drying operation with a set value (for example, 5, a reference value of the absolute deviations to determine breakage of the belt 33) (222). In the case that the average value is equal to or less than the set value, the controller 102 proceeds to operation 214 and stops the motor 31 and the compressor 53, determining that the belt 33 has been broken during the drying operation.

Subsequently, the controller 102 indicates breakage of the belt through the display unit 108 and sounds an alarm or a voice through the alarm unit 110 such that the user may recognize breakage of the belt 33.

When it is determined that the average value calculated during the drying operation is greater than the set value in operation 222, the controller 102 drives the motor 31 and the compressor 53 through the driving unit 106 to continue the drying operation, determining that the belt 33 is in a normal state during the drying operation.

The change rate of the degree of dryness of the objects to be dried decreases during the drying operation as above. The dryness sensor 90 determines the degree of dryness detected by contacting the objects rotating in the drum 20 and inputs the determined degree of dryness to the controller 102 (224).

Thereby, the controller 102 determines whether the degree of dryness determined by the dryness sensor 90 has reached the target degree of dryness (the degree of dryness at which the controller 102 determines that drying of the objects has been completed) (226). In the case that the target degree of dryness has not been reached, the controller 102 returns to operation 218 to detect breakage of the belt 33 and performs the drying operation.

When it is determined that the target degree of dryness has been reached in operation 226, the controller 102 stops driving the motor 31 and the compressor 53 through the driving unit 106 and terminates all drying operations (228).

In an embodiment, the dryness sensor 90 is used to detect breakage of the belt 33. However, embodiments are not limited thereto. The first temperature sensor 92 to detect the temperature of the air in the drum 20, i.e., the temperature at the outlet of the drum 20 may be used to detect breakage of the belt 33.

In the case that the belt 33 is broken or displaced, the drum 20 does not normally rotate but stops. Thereby, the hot and dry air (hot air) flowing into the drum 20 is not uniformly distributed to the inside of the drum 20, but is intensively supplied in only one direction (specifically, the direction in which the air introduced through the hot air inlet 22 travels). In this case, the hot and dry air (hot air) is also intensively supplied to the door 16, which is the direction in which the air introduced through the hot air inlet 22 travels. Thereby, the surface temperature of the door 16 may increase.

Accordingly, the first temperature sensor 92 detects the temperature at the outlet of the drum 20, which allows estimation of the surface temperature of the door 16 for a certain time and calculates the change in the temperature at the outlet of the drum 20. In the case that the calculated change in the temperature at the outlet of the drum 20 is equal to or greater than a determined change value, it may be determined that the belt 33 is broken.

Using the first temperature sensor 92 to detect the temperature at the outlet of the drum 20 is applicable as an example of various techniques for detection of breakage of the belt 33.

Next, a description will be given of keeping a proper surface temperature of the door 16 during the drying operation or after completion of the drying operation, with reference to FIG. 5.

As the drying operation proceeds, the temperature of the air in the drum 20 becomes high. Thereby, the surface temperature of the door 16 also increases. The increased surface temperature of the door 16 may burn the user. Therefore, the surface temperature of the door 16 needs to be controlled not to excessively increase during the drying operation or after completion of the drying operation. However, the surface temperature of the door 16 cannot be unconditionally lowered to protect the user from burns. This is because lowering the temperature of the inside of the drum 20 to lower the surface temperature of the door 16 may cause the objects to feel cold when the user removes the objects after completion of the drying operation, thereby causing the user to consider that drying quality has been degraded, despite actual completion of drying.

Accordingly, to prevent injury to the user and occurrence of lower temperature of the objects after drying and to provide a drying quality with which the user may be satisfied, a proper surface temperature of the door 16 needs to be maintained.

Figure 5:
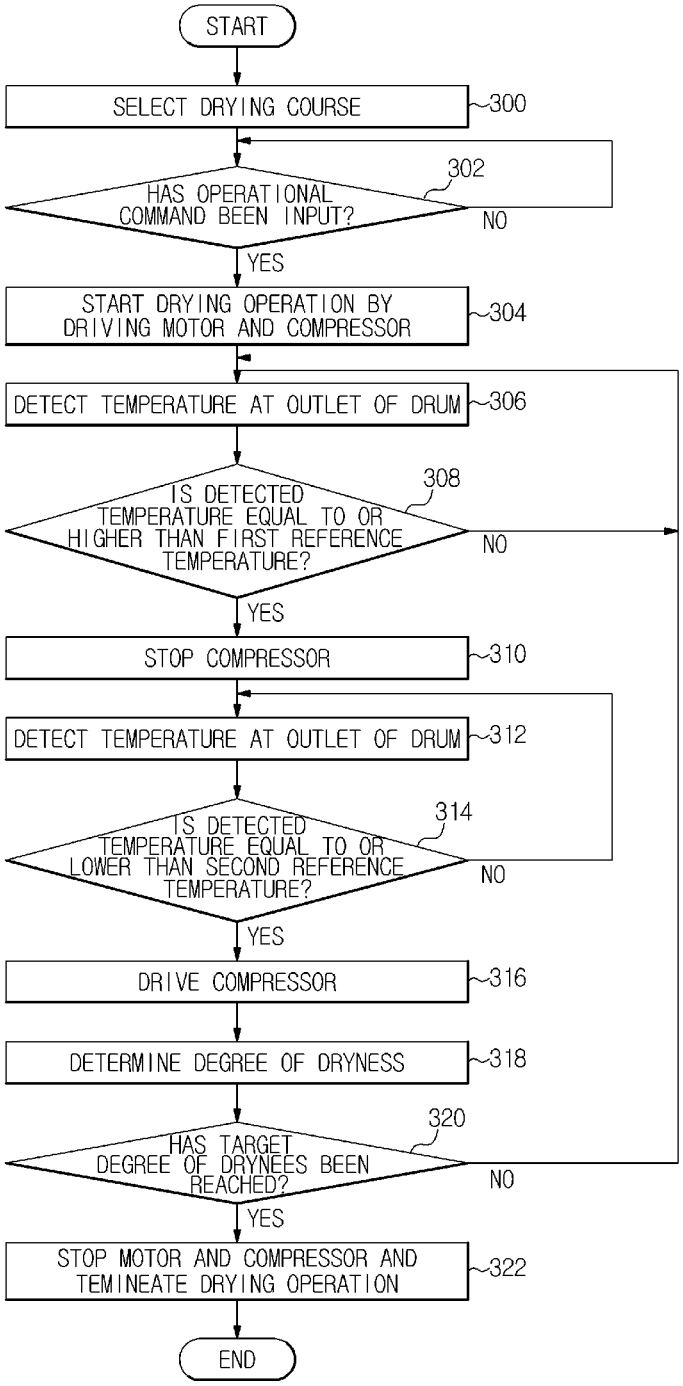
FIG. 5 is a flowchart illustrating a control algorithm to maintain a surface temperature of a door of a clothing dryer according to an embodiment.

FIG. 5 is a flowchart illustrating a control algorithm to maintain the surface temperature of a door of a clothing dryer according to an embodiment.

In FIG. 5, once the user puts objects to be dried into the drum 20 and selects one of the drying courses (including a normal-drying course, a towel-drying course, a perm-drying course and a delicate-drying course) according to the type of the objects to be dried (300), the information on the course selected by the user is input to the controller 102 through the input unit 100.

Then, the controller 102 determines whether an operation command has been input, to begin the drying operation according to the information on the drying course input through the input unit 100 (302).

When it is determined that an operation command has been input in operation 302, the controller 102 drives the motor 31 and the compressor 53 through the driving unit 106 to perform the drying operation (304).

When the drying operation begins, air begins to flow in the clothing dryer 1 according to rotation of the fan 43 by operation of the motor 31, and the power of the motor 31 is transferred to the drum 20 via the belt 33. Thereby, the drum 20 rotates according to the transferred power, rotating the objects to be dried in the drum 20.

At this time, the compressor 53 compresses and discharges the refrigerant at high temperature and high pressure to heat the air moving in the clothing dryer 1. The refrigerant compressed at high temperature and high pressure by the compressor 53 releases heat, forming a refrigeration cycle by passing through the condenser 52 and the evaporator 51 and then being suctioned into the compressor 53.

Accordingly, the air flowing in the clothing dryer 1 turns into hot and dry air as it passes through the condenser 52 of the dehumidification unit 50. Then, the hot and dry air is guided into the inflow channel 41 along the guide channel 54. The hot and dry air (hot air) guided into the inflow channel 41 is caused to flow along the inflow channel 41 and enter the drum 20 through the hot air inlet 22, by rotation of the fan 43. The hot and dry air (hot air) introduced into the drum 20 contacts the objects to be dried which are repeatedly lifted and dropped by being rotated in the drum 20, drying the objects by evaporating the moisture contained in the objects.

When the drying operation proceeds according to operation of the motor 31 and compressor 53, the air temperature in the drum 20 increases to a higher level. Thereby, the surface temperature of the door 16 also increases.

Accordingly, the first temperature sensor 92 installed at the side of the discharge channel 42 detects the air temperature in the drum 20 which increases during the drying operation, i.e., the temperature at the outlet of the drum 20, and inputs the detected temperature to the controller 102 (306).

Thereby, the controller 102 determines whether the temperature at the outlet of the drum 20 detected by the first temperature sensor 92 is equal to or greater than a determined first reference temperature (the minimum temperature which may cause a burn due to the hot surface temperature of the door 16, about 60° C.) (308).

When it is determined, in operation 308, that the temperature at the outlet of the drum 20 is not equal to or greater than the first reference temperature, the controller 102 returns to operation 306 and performs subsequent operations.

When it is determined, in operation 308, that the temperature at the outlet of the drum 20 is equal to or greater than the first reference temperature, the controller 102 stops the compressor 53 through the driving unit 106 (310). Once the compressor 53 is stopped, heating of the air flowing in the clothing dryer 1 is stopped. Therefore, the air temperature in the drum 20 is lowered, and thereby the surface temperature of the door 16 is also lowered.

Even when the compressor 53 is stopped, the motor 31 operates to continue rotating the drum 20 and the fan 43.

Thereafter, the first temperature sensor 92 detects the air temperature in the drum 20 which is lowered according to stopping of the compressor 53, and inputs the detected temperature to the controller 102 (312).

Accordingly, the controller 102 determines whether the temperature at the outlet of the drum 20 detected by the first temperature sensor 92 is equal to or less than a determined second reference temperature (the maximum temperature which makes the objects to be dried cold enough to result in a lower drying efficiency, about 50° C.) (314).

When it is determined, in operation 314, that the temperature at the outlet of the drum 20 is not equal to or less than the second reference temperature, the controller 102 returns to operation 312 and performs subsequent operations.

When it is determined, in operation 314, that the temperature at the outlet of the drum 20 is equal to or less than the second reference temperature, the controller 102 drives the compressor 53 through the driving unit 106 again (316). When the compressor 53 is driven, heating of the air flowing in the clothing dryer 1 resumes and the air temperature in the drum 20 increases. Thereby, the surface temperature of the door 16 also increases.

By driving or stopping the compressor 53 according to the temperature at the outlet of the drum 20 as above, the surface temperature of the door 16 may be properly maintained between the first reference temperature (60° C.) and the second reference temperature (50° C.). However, the temperature at the outlet of the drum 20 differs from the surface temperature of the door 16 by about 5° C. Therefore, the surface temperature of the door 16 is maintained between about 55° C. and about 45° C., in reality.

Since the drying operation is continued while the surface temperature of the door 16 is properly maintained, the change rate of the degree of dryness of the objects to be dried decreases. Therefore, the dryness sensor 90 determines the degree of dryness of the objects to be dried rotating in drum 20, which is detected when the dryness sensor 90 contacts the objects, and inputs the determined degree of dryness to the controller 102 (318).

Accordingly, the controller 102 determines whether the degree of dryness determined by the dryness sensor 90 has reached the target degree of dryness (the degree of dryness at which the controller 102 determines that drying the objects has been completed) (320). In the case that the target degree of dryness has not been reached, the controller 102 returns to operation 306 to maintain a proper surface temperature of the door 16 and perform the drying operation.

When it is determined, in operation 320, that the target degree of dryness has been reached, the controller 102 stops driving the motor 31 and the compressor 53 through the driving unit 106 and terminates all drying operations (322).

Next, a description will be given of detecting incorrect or broken wiring of the compressor 53 at the beginning of the drying operation, with reference to FIG. 6.

In the case that the terminals of the compressor 53 are incorrectly connected, the compressor 53 may be overloaded. In the worst case, the terminals of the compressor 53 may explode, resulting in loud noise and sparks. Further, the refrigerant may leak, causing harm to the user. Therefore, when the terminals of the compressor 53 are incorrectly connected, the compressor 53 and the clothing dryer 1 need to be stopped before the terminals of the compressor 53 explode, in order to remove the danger that may be caused by explosion. In an embodiment, such incorrect or broken wiring of the compressor 53 may be detected at the beginning of the drying operation.

Figure 6:
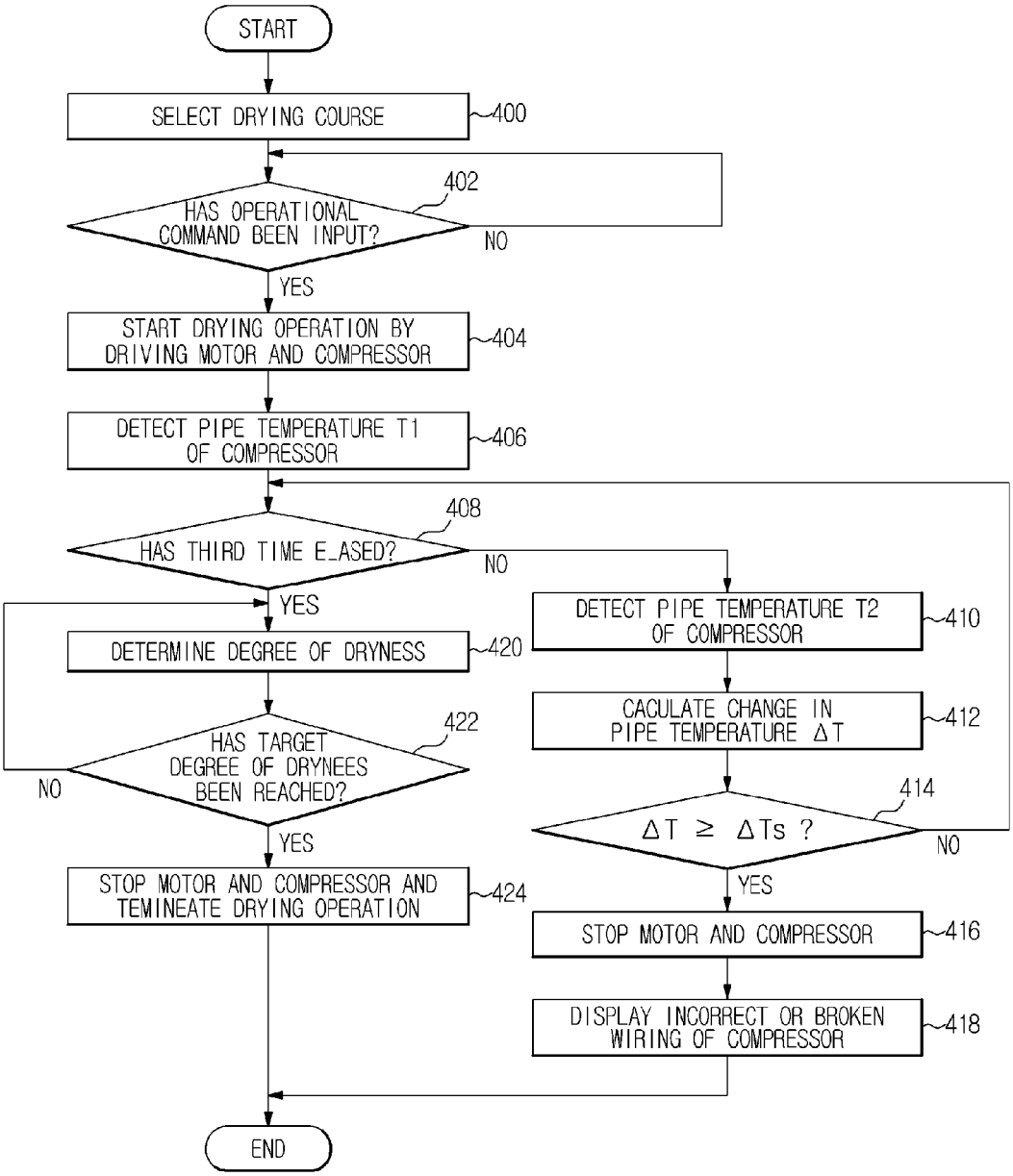
FIG. 6 is a flowchart illustrating a control algorithm to detect incorrect or broken wiring of a compressor of a clothing dryer according to an embodiment.

FIG. 6 is a flowchart illustrating a control algorithm to detect incorrect or broken wiring of a compressor of a clothing dryer according to an embodiment.

In FIG. 6, once the user puts objects to be dried into the drum 20 and selects one of the drying courses (including a normal-drying course, a towel-drying course, a perm-drying course and a delicate-drying course) according to the type of the objects to be dried (400), the information on the course selected by the user is input to the controller 102 through the input unit 100.

Then, the controller 102 determines whether an operation command has been input, to begin the drying operation according to the information on the drying course input through the input unit 100 (402).

When it is determined, in operation 402, that an operation command has been input, the controller 102 drives the motor 31 and the compressor 53 through the driving unit 106 to begin the drying operation (404).

When the drying operation begins, air begins to flow in the clothing dryer 1 according to rotation of the fan 43 by operation of the motor 31, and the power of the motor 31 is transferred to the drum 20 via the belt 33. Thereby, the drum 20 rotates according to the transferred power, rotating the object to be dried in the drum 20.

At this time, the compressor 53 compresses and discharges the refrigerant at high temperature and high pressure to heat the air moving in the clothing dryer 1. The refrigerant compressed at high temperature and high pressure by the compressor 53 releases heat, forming a refrigeration cycle by passing through the condenser 52 and the evaporator 51 and then being suctioned into the compressor 53.

Accordingly, the air flowing in the clothing dryer 1 turns into hot and dry air as it passes through the condenser 52 of the dehumidification unit 50. Then, the hot and dry air is guided into the inflow channel 41 along the guide channel 54. The hot and dry air (hot air) guided into the inflow channel 41 is caused to flow along the inflow channel 41 and enter the drum 20 through the hot air inlet 22, by rotation of the fan 43. The hot and dry air (hot air) introduced into the drum 20 contacts the objects to be dried which are repeatedly lifted and dropped by being rotated in the drum 20, drying the objects by evaporating the moisture contained in the objects.

When the drying operation proceeds according to operation of the motor 31 and compressor 53, the temperature of the pipe connected to the discharge side of the compressor 53 begins to rise due to the temperature of the refrigerant discharged from the compressor 53. In the case of incorrect or broken wiring of the compressor 53, the temperature of the pipe of the compressor 53 drastically rises.

Accordingly, the second temperature sensor 94 installed at the discharge side of the compressor 53 detects the initial pipe temperature T1 of the compressor 53 at the beginning of the drying operation and inputs the detected temperature to the controller 102 (406).

Then, the controller 102 determines whether a third time (the maximum amount of time needed to detect incorrect or broken wiring of the compressor 53, about 10 minutes) has elapsed since the beginning of the drying operation (408). In the case that the terminals of the compressor 53 are incorrectly connected, the temperature of the pipe of the compressor 53 drastically rises. Therefore, the change in the temperature of the pipe due to incorrect or broken wiring of the compressor 53 is detected within the third time after the drying operation begins.

When it is determined, in operation 408, that the third time has not elapsed since the beginning of the drying operation, the second temperature sensor 94 continues to detect a pipe temperature T2 of the pipe of the compressor 53, and inputs the detected pipe temperature T2 to the controller 102 (410).

Accordingly, the controller 102 calculates the change in pipe temperature ($\Delta T = T2 - T1$) using the pipe temperature T2 detected by the second temperature sensor 94 and the initial pipe temperature T1 detected at the beginning of the drying operation (412).

Then, the controller 102 compares the calculated change in pipe temperature ($\Delta T$) with a reference temperature change ($\Delta Ts$, the change in pipe temperature due to incorrect or broken wiring of the compressor 53, which is about 50° C.), and determines whether the change in pipe temperature ($\Delta T$) is equal to or greater than the reference temperature change ($\Delta Ts$) (414).

When it is determined, in operation 414, that the change in pipe temperature ($\Delta T$) is not equal to or greater than the reference temperature change ($\Delta Ts$), the controller 102 returns to operation 408 and performs subsequent operations.

Meanwhile, when it is determined, in operation 414, that the change in pipe temperature ($\Delta T$) is equal to or greater than the reference temperature change ($\Delta Ts$), the controller 102 stops the motor 31 and the compressor 53 through the driving unit 106 and terminates the drying operation, determining that incorrect or broken wiring of the compressor 53 has occurred at the beginning of the drying operation (416).

Then, the controller 102 displays incorrect or broken wiring of the compressor 53 through the display unit 108 and sounds an alarm or a voice through the alarm unit 110 such that the user recognizes incorrect or broken wiring of the compressor 53 (418).

In addition, when it is determined, in operation 408, that the third time has elapsed since the beginning of the drying operation, the controller 102 controls operation of the motor 31 and the compressor 53 through the driving unit 106 to continue the drying operation since rise in pipe temperature due to incorrect or broken wiring of the compressor 53 has been detected. In the case that there is incorrect or broken wiring of the compressor 53, the change in pipe temperature ($\Delta T$) is allowed to reach the reference temperature change ($\Delta Ts$) within the third time after the beginning of the drying operation since the pipe temperature of the compressor 53 drastically rises after the compressor 53 is operated. Therefore, when the third time elapses, the controller 102 does not detect the pipe temperature of the compressor 53 anymore and performs the drying operation, determining that wiring of the compressor 53 is normal.

The degree of dryness of the objects to be dried begins to decrease according to the drying operation as above. The dryness sensor 90 determines the degree of dryness of the objects to be dried rotating in drum 20, which is detected when the dryness sensor 90 contacts the objects, and inputs the determined degree of dryness to the controller 102 (420).

Accordingly, the controller 102 determines whether the degree of dryness determined by the dryness sensor 90 has reached the target degree of dryness (the degree of dryness with which the controller 102 determines that drying the objects has been completed) (422). In the case that the target degree of dryness has not been reached, the controller 102 returns to operation 420 and performs subsequent operations.

When it is determined, in operation 422, that the target degree of dryness has been reached, the controller 102 stops driving the motor 31 and the compressor 53 through the driving unit 106 and terminates all drying operations (424).

As is apparent from the above description, according to a clothing dryer and a control method thereof as proposed, a conventional dryness sensor may be used, without installation of a separate component, to determine breakage of a belt. When a sensor value is kept equal to or less than a specific value without undergoing variation for a specific time, it is determined that the belt is broken, and the motor is stopped together with report of abnormality of the belt through an alarm or a visible indication. Thereby, cost may be reduced, and a proper action may be taken.

In addition, according to a clothing dryer and a control method thereof as proposed, a conventional temperature sensor may be used to maintain a proper surface temperature of a door of the clothing dryer, without installation of a separate component. Thereby, harm to a user due to rise in the surface temperature of the door may be prevented. Moreover, degradation of drying quality resulting from decease in temperature of objects to be dried may also be prevented.

Furthermore, the pipe temperature of a compressor adapted to compress a refrigerant to produce hot air to be supplied into a drum is detected. Thereby, in the case that the pipe temperature increases beyond a specific temperature, it is determined that incorrect or broken wiring of the compressor has occurred, and the compressor is stopped together with report of abnormality of the belt through an alarm or a visible indication. Thereby, the product may be protected and a proper action may be taken.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. A control method of a clothing dryer provided with a drum to accommodate an object to be dried, a motor to generate power to rotate the drum, and a belt to transfer the power of the motor to the drum, the control method comprising:

rotating the drum according to operation of the motor to dry the object;

detecting a degree of dryness of the object for a specific time and calculating change in the degree of dryness;

converting the degree of dryness to pulse values, and accumulating deviations of the pulse values for the specific time;

determining that the belt is abnormal if a mean absolute deviation of the accumulated pulse values is equal to or less than a set value, the abnormality being that the belt is either broken or displaced; and stopping the motor when determining that the belt is abnormal.

2. The control method according to claim 1, wherein:

a first time period begins at the beginning of the drying operation;

the specific time is a second time period during the drying operation before the first time period elapses, and the second time period is shorter than the first time period.

3. The control method according to claim 1, wherein the specific time is a time period since beginning of the change in the degree of dryness during a drying operation.

4. The control method according to claim 2, wherein the first time is about 20 minutes.

5. The control method according to claim 2, wherein the second time is about 10 minutes.

6. The control method according to claim 1, further comprising stopping the motor and at the same time stopping a compressor to compress a refrigerant to heat air flowing into the drum, when determining that the belt is abnormal.

7. The control method according to claim 1, further comprising, reporting that the belt is abnormal through an alarm or a visible indication, when determining that the belt is abnormal.

8. A clothing dryer comprising:

a drum to accommodate an object to be dried;

a motor to generate power to rotate the drum;

a belt to transfer the power of the motor to the drum;

a dryness sensor to detect a degree of dryness of the object, and output pulse values that correspond to the degree of dryness of the object; and a controller to detect change in sensor values of the dryness sensor for a specific time to determine whether the belt is abnormal, the abnormality being that the belt is either broken or displaced, wherein the controller is arranged to accumulate deviations of the pulse values input through the dryness sensor for the specific time, and to determine that the belt is abnormal when a mean absolute deviation of the accumulated pulse values is equal to or less than a set value.

9. The clothing dryer according to claim 8, wherein the degree of dryness is converted into an electrical signal.

10. The clothing dryer according to claim 8, wherein the controller stops the motor when the controller determines that the belt is abnormal.

11. The clothing dryer according to claim 10, wherein, when the controller determines that the belt is abnormal, the controller stops the motor and at the same time stops a compressor to compress a refrigerant to heat air flowing into the drum.

12. The clothing dryer according to claim 10, further comprising a display unit to display abnormality of the belt or an alarm unit to produce an alarm sound or a buzzer sound, in order to report that the belt is abnormal.

13. A control method of a clothing dryer provided with a door and a drum to accommodate an object to be dried, a motor to rotate the drum, and a compressor to compress a refrigerant to heat air flowing into the drum, the control method comprising:

performing a drying operation by driving the motor and the compressor;

detecting a temperature of air discharged from the drum using a temperature sensor during the drying operation; and comparing the detected temperature at the outlet of the drum with a predetermined reference temperature, and controlling operation of the compressor according to a result of the comparison to keep a surface temperature of the door constant.

14. The control method according to claim 13, wherein the temperature sensor is a thermistor.

15. The control method according to claim 14, wherein the thermistor is installed in a discharge channel allowing the air having passed through the drum to be discharged therethrough.

16. The control method according to claim 13, wherein the controlling of the operation of the compressor comprises:

stopping the compressor when the temperature of the discharged air of the drum is equal to or higher than a first reference temperature; and driving the compressor when the temperature of the discharged air of the drum is equal to or higher than a second reference temperature.

17. The control method according to claim 16, wherein the motor is driven regardless of whether or not the compressor is stopped.

18. The control method according to claim 3, wherein the time is about 10 minutes.

19. A control method of a clothing dryer provided with a door and a drum to accommodate an object to be dried, a motor to rotate the drum, and a compressor to compress and discharge a refrigerant through a pipe to heat air flowing into the drum, the control method comprising:

performing a drying operation by driving the motor and the compressor;

detecting an initial pipe temperature of the pipe using a temperature sensor installed at a discharge side of the compressor at the beginning of the drying operation;

determining whether a predetermined time has elapsed during the drying operation;

detecting a current pipe temperature after the predetermined time has elapsed and calculating a difference between the initial pipe temperature and the current pipe temperature; and controlling operation of the motor and compressor according to a result of the calculated difference to protect the clothing dryer from damage due to broken wiring or incorrect wiring of the clothing dryer causing a heat surge and informing the user according to the result by a sound or a visual display.

* * * * *